US012495873B2

(12) United States Patent
OBorsky

(10) Patent No.: US 12,495,873 B2
(45) Date of Patent: Dec. 16, 2025

(54) COMPACT REUSABLE TOTE

(71) Applicant: Keote Bags LLC, Minneapolis, MN (US)

(72) Inventor: Rachael Lee OBorsky, Elk River, MN (US)

(73) Assignee: Keote Bags LLC, Minneapolis, MN (US)

( * ) Notice: Subject to any disclaimer, the term of this patent is extended or adjusted under 35 U.S.C. 154(b) by 29 days.

(21) Appl. No.: 18/439,533

(22) Filed: Feb. 12, 2024

(65) Prior Publication Data

US 2024/0268533 A1 Aug. 15, 2024

Related U.S. Application Data

(60) Provisional application No. 63/484,495, filed on Feb. 11, 2023.

(51) Int. Cl.

| | |
|---|---|
| ***A45C 7/00*** | (2006.01) |
| ***A45C 3/04*** | (2006.01) |
| ***A45C 13/10*** | (2006.01) |

(52) U.S. Cl.

CPC ..... *A45C 7/0077* (2013.01); *A45C 3/04* (2013.01); *A45C 13/1076* (2013.01)

(58) Field of Classification Search

CPC ..... A45C 7/0077; A45C 3/04; A45C 13/1076
USPC ..... 383/2, 7
See application file for complete search history.

(56) References Cited

U.S. PATENT DOCUMENTS

| | | | | |
|---|---|---|---|---|
| D265,864 | S | 8/1982 | Kracke | |
| D374,348 | S | 10/1996 | Sarver | |
| D422,411 | S | 4/2000 | Martin | |
| 6,230,950 | B1 * | 5/2001 | Heetman | A45C 7/0077 224/901.2 |
| D497,050 | S | 10/2004 | Grambush | |
| D587,010 | S | 2/2009 | Deck | |
| D648,935 | S | 11/2011 | Wickrama | |
| D971,598 | S | 12/2022 | Dumas | |

(Continued)

FOREIGN PATENT DOCUMENTS

| | | | |
|---|---|---|---|
| CN | 110051094 A * | 7/2019 | |
| CN | 305711578 | 4/2020 | |
| FR | 2744601 A1 * | 8/1997 | A45C 7/0077 |

(Continued)

OTHER PUBLICATIONS

Machine translation of FR-2744601-A1. (Year: 1997).*

(Continued)

*Primary Examiner* — Jes F Pascua
(74) *Attorney, Agent, or Firm* — Christensen, Fonder, Dardi & Herbert PLLC; Andrew H. Auderieth

(57) ABSTRACT

A compact reusable tote includes a sac and a closure flap. The sac is configured to transition between an open carry configuration and a compressed storage configuration. The sac includes generally symmetrical front and back panels having a generally rectangular lower portion and an upper portion including a strap. The front and back panels define an interior compartment. A closure flap having cooperating fastener portions is affixed to a sac panel. In the storage configuration the cooperating fastener portions are mated to one another such that no portion of the sac extends substantially beyond the left and right edges of the closure flap.

19 Claims, 5 Drawing Sheets

(56) References Cited

U.S. PATENT DOCUMENTS

| | | | | |
|---|---|---|---|---|
| 2010/0086237 | A1* | 4/2010 | Diepen | A45C 3/04 383/110 |
| 2017/0127777 | A1 | 5/2017 | Cohen | |

FOREIGN PATENT DOCUMENTS

| | | | | | |
|---|---|---|---|---|---|
| FR | 3048338 | A1 | * | 9/2017 | |
| GB | 2458267 | B | * | 4/2012 | A45C 3/04 |
| GB | 2552684 | A | * | 2/2018 | A45C 7/0077 |
| KR | 20100011680 | U | * | 12/2010 | |
| KR | 20140039942 | A | * | 4/2014 | |

OTHER PUBLICATIONS

Machine translation of FR-3048338-A1. (Year: 2017).*

Amazon.co.jp, Site visited Jul. 29, 2025, Torune P-3239 Eco Bag, Date first available, Oct. 31, 2015, https://www.amazon.co.jp/-/en/Torune-P-3239-Convenience-Store-Large/dp/B012MS3GBC (Year: 2015).

Amazon.co.jp, Site visited Jul. 29, 2025, Aurora Eco Bag, Date first available, Sep. 1, 2020, https://www.amazon.co/jp/-/en/ Aurora-Large-Gusset-Convenience-Shopping/dp/B08H53GX3V?th=1 (Year: 2020).

Amazon.sg, Site visited Jul. 29, 2025, Savoy SM43201 Women's Bag, Date first available, Mar. 10, 2022, https://www.amazon.sg/Savoy-SM43201-Wonens-biege-Size/dp/B09STMKLD (Year: 2022).

* cited by examiner

COMPACT REUSABLE TOTE

CROSS-REFERENCE TO RELATED APPLICATION

This application claims the benefit of U.S. Provisional Application No. 63/484,495, filed Feb. 11, 2023, the entire contents of which is incorporated by reference herein.

FIELD OF THE DISCLOSURE

This invention relates to totes. More specifically, this invention relates to a tote bag convertible to a compressed transport configuration.

BACKGROUND

Tote bags are often made of plastic or flexible fabrics. Tote bags have an interior compartment for receiving articles and typically have a set of handles. Some tote bags have handles affixed to the body of the bag, for example, by stitching or sewing. Some tote bags have handles that are integral with the body. Tote bags may be somewhat large and unwieldly, making them inconvenient to carry when empty.

SUMMARY

Because tote bags are generally inconvenient to transport when not in use, many retailers offer disposable or single use bags to shoppers, generating otherwise avoidable waste. In addition to the environmental burden associated with single use bags, there is a financial cost as well which is often passed to the consumer by inflating the retail price of products. In an increasingly popular trend, some retailers, such as grocery stores, are directly charging consumers for any bags required at checkout. Accordingly, consumers are seeking reusable bags that are convenient to carry when not in use. Further, consumers are swayed by the aesthetic appeal of such reusable bags when determining what bags they are willing to carry with them.

A compact reusable tote in accordance with embodiments of this disclosure includes a sac and a closure flap. The sac is configured to transition between an open carry configuration and a compressed storage configuration. The sac includes a front panel affixed to a back panel. The front and back panels may be generally symmetrical. Each panel may have a generally rectangular lower portion and an upper portion including a strap. The front and back panels define an interior compartment. The closure flap may have a generally rectangular shape including opposing top and bottom margins, and opposing left and right edges. The bottom margin may be affixed to the sac. The bottom margin of the closure flap may have a first fastener portion which cooperates with a second fastener portion. The second fastener portion may be affixed along the top margin. In the storage configuration the first and second fastener portions are mated to one another such that no portion of the sac extends beyond the left and right edges of the closure flap.

In some embodiments, a gusset panel may be disposed between the front and back panels. In some embodiments, the interior compartment in the open carry configuration has a volume between 600 and 1200 cubic inches. In some embodiments, the interior compartment in the compressed storage configuration has a volume less than 50 cubic inches. In some embodiments, a width of the front panel is between 4 and 4.5 times a width of the closure flap. In some embodiments, a length of the front panel is between 2 and 2.5 times a length of the closure flap.

According to an embodiment, a method of transitioning a compact reusable tote having a sac affixed to a bottom margin of a closure flap from an open carry configuration to a compressed storage configuration includes the steps of laying the sac flat such that a front panel lays atop a back panel with outside edges of the panels being substantially aligned and a pair of straps extend upwardly; folding the pair of straps downwardly such that the sac has a clearly defined rectangular shape with a left, right, bottom, and top edges; arranging the closure flap to project upwardly from the top edge of the sac such a left and a right edge of the flap are generally parallel to the left and right edges of the sac; folding a right edge of the sac over the front panel at a first crease, the first crease being axially aligned with the right edge of the closure flap; folding and/or rolling a left edge of the sac over the front panel; folding and/or rolling the bottom edge of the sac upwardly towards the closure flap until the rolled up sac reaches the closure flap; rolling the closure flap around the rolled up sac until the bottom margin of the closure flap reaches a top margin of the closure flap; and fastening the bottom margin of the closure flap to a top margin of the closure flap.

According to embodiments, a collapsible tote includes a rectangular closure flap and a sac. The rectangular closure flap has a top margin configured to fasten to a bottom margin. The sac includes symmetrical front and back panels, the front and back panels are affixed along left, right, and bottom edges and defines an interior compartment therebetween. The bottom margin of the rectangular closure flap is affixed to a top edge of the sac back panel at a midpoint between the left and panel edges. The sac is configured to roll into a bundle and may be secured in place when the top flap margin is secured to the bottom flap margin. In some embodiments, the sac is configured to transition between an open carry configuration and a compressed storage configuration. In some embodiments, the sac is confined within a left margin and a right margin of the rectangular closure flap in the compressed storage configuration. In some embodiments, the sac is made from a water resistant material. In some embodiments, the water resistant material is nylon. In some embodiments, the rectangular closure flap is synthetic leather.

Figure 1A:
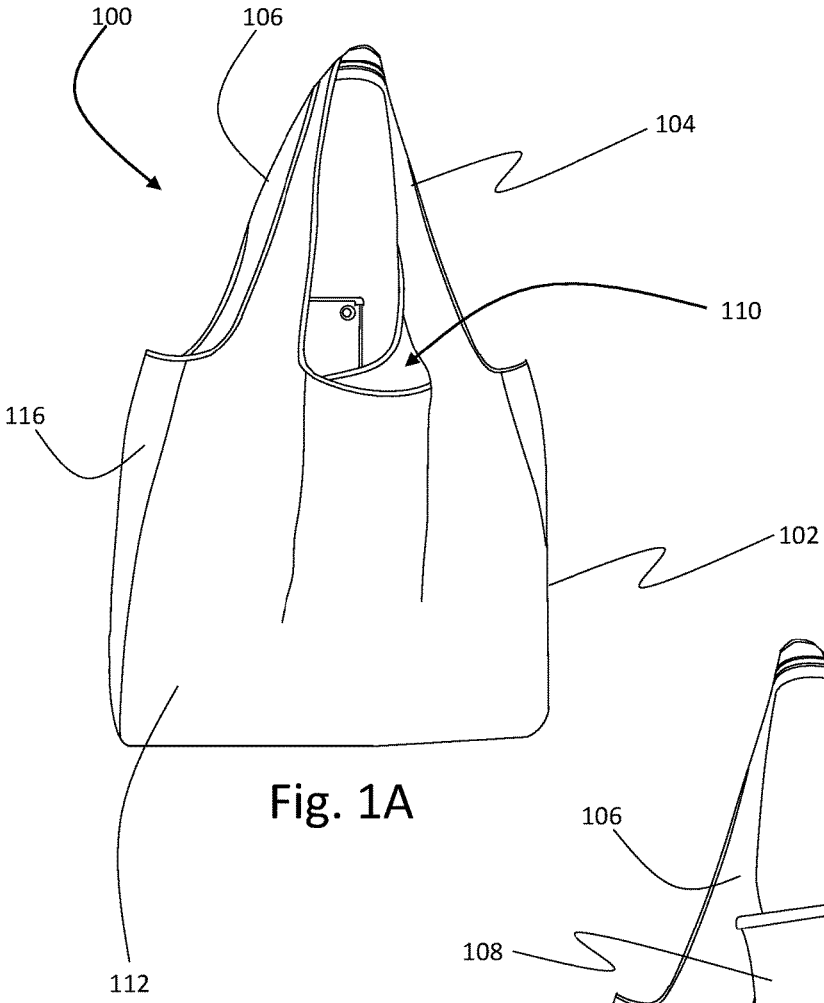
FIG. 1A is a front perspective view of a reusable tote in accord with embodiments.

While embodiments of the disclosure are amenable to various modifications and alternative forms, specifics thereof have been shown by way of example in the drawings and will be described in detail. It should be understood, however, that the intention is not to limit the disclosure to the particular embodiments described. On the contrary, the intention is to cover all modifications, equivalents, and alternatives falling within the spirit and scope of the disclosure.

DETAILED DESCRIPTION

Figure 1B:
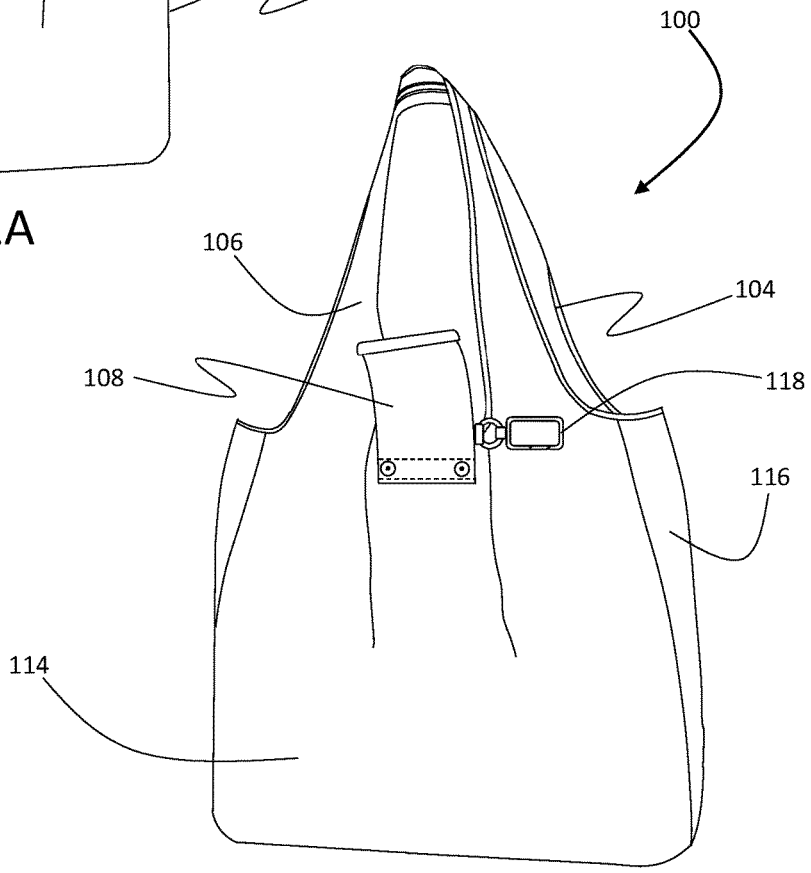
FIG. 1B is a rear perspective view of the reusable tote of FIG. 1A.

Referring to FIGS. 1A and 1B, a reusable tote bag 100 with a sac 102, handles 104, 106 and closure flap 108 is illustrated. The sac 102 defines an interior compartment 110 that may be used to carry objects such as groceries or the like. The sac 102 may include a front panel 112 and a back panel 114. In some embodiments, one or more gusset panels 116 may be disposed between the front and back panels 112, 114. The closure flap 108 may be affixed to the back panel 114. In some embodiments, the closure flap 108 may include a keychain 118 or the like.

Figure 2A:
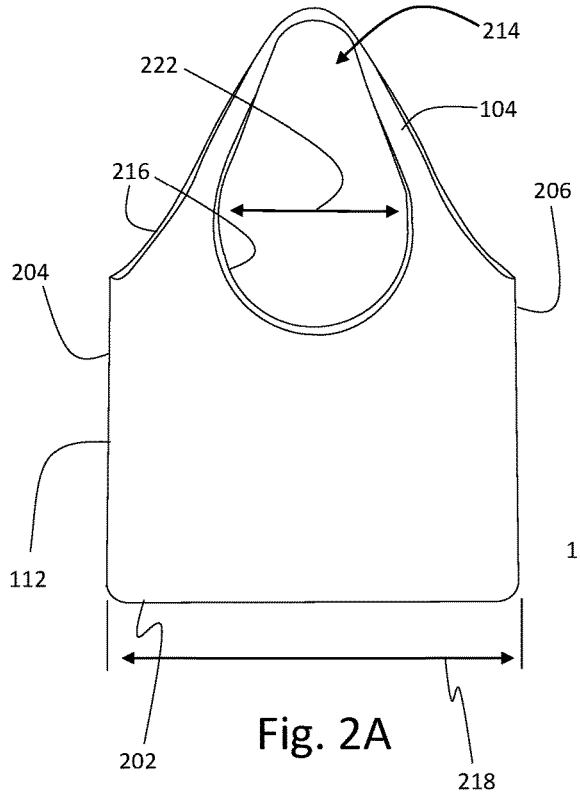
FIG. 2A a front panel of a reusable tote in accord with embodiments.
Figure 2B:
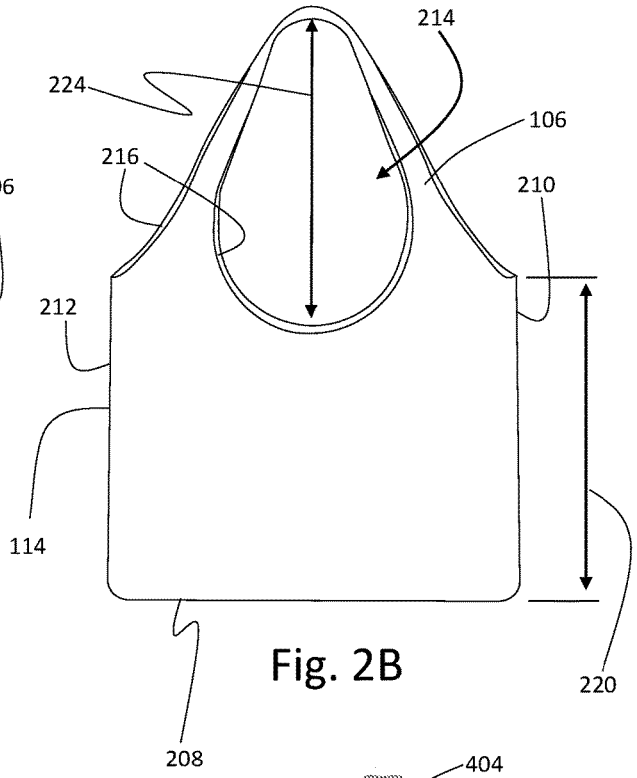
FIG. 2B is a rear panel of a reusable tote in accord with embodiments.

Referring to FIGS. 2A and 2B, the front and back panels 112, 114 are illustrated. The front and back panels 112, 114 are generally symmetrical and share common dimensions. The front panel 112 has a bottom edge 202, a left edge 204, and a right edge 206. The back panel 114 has a bottom edge 208, a left edge 210, and a right edge 212. The front and right back 112, 114 taper upwardly towards the top with integral handles 104, 106 defining a tear drop or egg-shaped handle opening 214. In embodiments, exposed edges of the front and back panels 112, 114 may be hemmed, bound, or the like to reduce fraying and increase tensile strength about the handles 104, 106. In some embodiments of a strip of fabric 216 similar to the fabric used for the front and back panels 112, 114 may cover the exposed edges and be stitched along margins of the exposed edges front and back panels 112, 114. In some embodiments, the strip of fabric 216 may be a different type of fabric or material such as synthetic leather, leather, or the like.

The front and back panels 112, 114 have a width 218 as measured along the bottom edge 202, 208. In some embodiments, the width 218 may be between 10 and 20 inches. In some embodiments, the width 218 may be between 6 and 16 inches. In some embodiments, the width 218 may be about 14 inches. In some embodiments, the width 218 may be about 17 inches. The front and back panels 112, 114 have a height 220 as measured along the right edges 206, 212 or left edges 204, 210. In some embodiments, the height 220 may be between 10 and 20 inches. In some embodiments, the height 220 may be between 8 and 18 inches. In some embodiments, the height 220 may be about 15 inches. In some embodiments, the height 220 may be about 14 inches. The tear drop shaped handle opening 214 may have a width 222 and a height 224 at the widest points of the opening 214. In some embodiments, the opening width 222 may be between 3 and 10 inches. In some embodiments, the opening width 222 may be about 6 inches. In some embodiments, the opening height 224 may be between 6 and 12 inches. In some embodiments, the opening height 224 may be about 9 inches. In some embodiments, the opening height 224 may be about 50 percent larger than the opening width 222.

Figure 3:
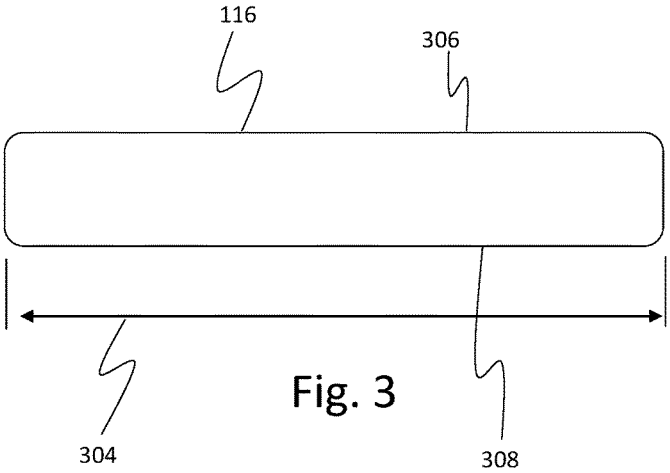
FIG. 3 is a gusset panel of a reusable tote in accord with embodiments.
Figure 4:
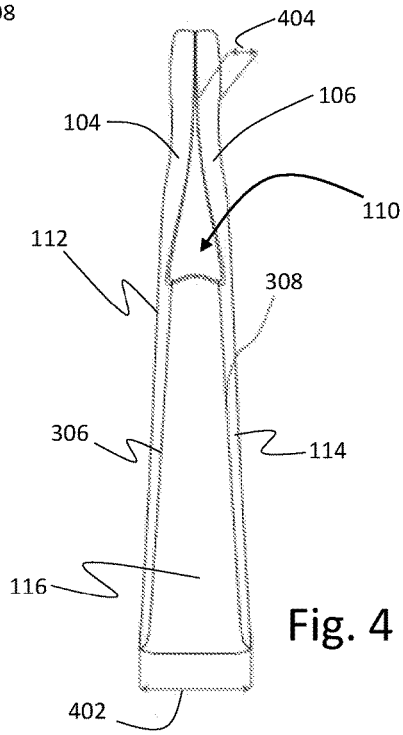
FIG. 4 is a side view of a reusable tote in accord with embodiments.

In some embodiments, corresponding edges of the front and back panels 112, 114 may be stitched to one another thereby forming the sac portion. Referring to FIGS. 3 and 4, in some embodiments, a gusset panel 116 may be disposed between the front and back panels 112, 114. The gusset panel 116 has a length 304 that corresponds to the combined lengths of the of the bottom, right, and front edges of a panel. In some embodiments, the length 304 of the gusset panel 116 is about 44 inches. In some embodiments, the length 304 of the gusset panel 116 may be between 20 and 60 inches.

The gusset panel 116 may be disposed between the front and back panels 112, 114. For example, the gusset panel 116 may be affixed along a first lengthwise edge 306 to front panel 112 and along an opposing lengthwise edge 308 to back panel 114. The gusset panel 116 may be affixed to the front and back panels 112, 114, for example, by stitching, sewing, or the like. The gusset panel 116 may have a width 402. In some embodiment, the gusset panel 116 width 402 is between 2 and 8 inches. In some embodiments, the width 402 is about 4 inches. Accordingly, the interior compartment 110 has a volume, the tote is an open and uncompressed state, defined by the length 220 and width 218 of the front or back panels 112, 114 and the width 402 of the gusset panels. In some embodiments, the volume of the interior compartment 110 is between 600 and 1200 cubic inches. In some embodiments, the volume of the interior compartment is between 900 and 1000 cubic inches. In some embodiments, the volume of the interior compartment is about 950 cubic inches. As will be discussed in more detail below, in some embodiments, the tote 100 is folded or rolled into a compressed configuration. In the compressed storage configuration, the interior compartment 110 may have a volume approaching zero. In some embodiments, the interior compart 110 has a volume of less than 50 cubic inches in the compressed storage configuration. In some embodiments, additional gussets may be affixed between the front and back panels form a wider tote having an interior compartment with an increased volume. In embodiments, the handles 104, 106 have a width 404 as can be seen in FIG. 4. In some embodiments, the handle 104, 106 width 404 is between 1 and 4 inches. In some embodiments, the width 404 is about 1.77 inches.

In some embodiments, the front, back, and gusset panels 112, 114, 116 are formed of the same or similar materials. In some embodiments, the panels are formed of a spun fabric such as yarn. In some embodiments, the panels are formed of synthetic polymers. In some embodiments the panels are nylon. For example, the panels may be formed nylon. In some embodiments, the nylon is ripstop nylon. In some embodiments the panels are waterproof or water-resistant. In some embodiments, the panel fabric has a weight of 105 GSM. In some embodiments, the tote has a carrying capacity of up to 50 pounds.

Figure 5A:
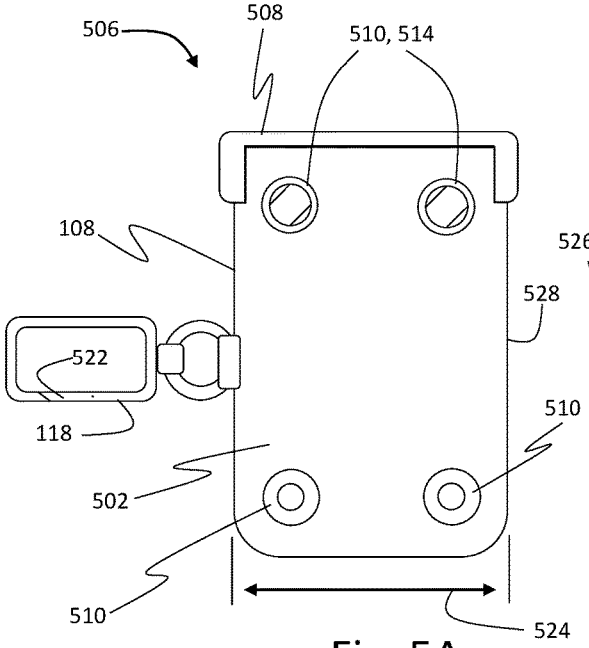
FIG. 5A is a front view of a closure flap in accord with embodiments.
Figure 5B:
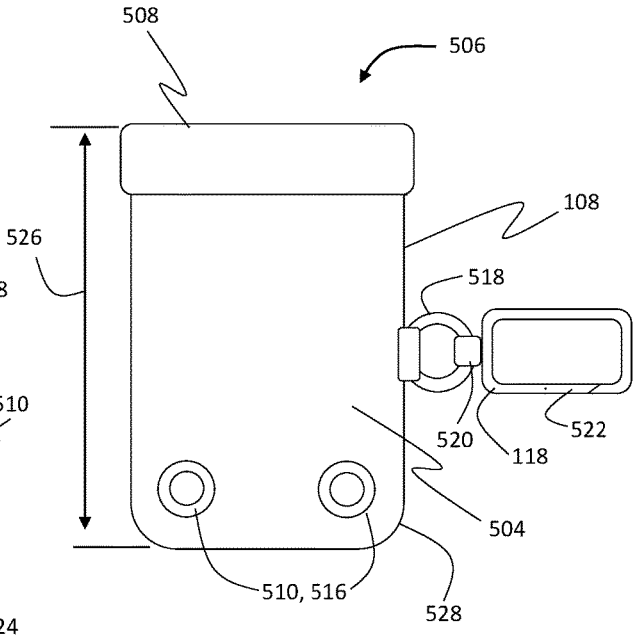
FIG. 5B is a rear view of the closure flap of FIG. 5A.

Referring to FIGS. 5A and 5B, a closure flap 108 is illustrated having a forward facing surface 502 and a rearward facing surface 504. As will be described in further detail below, in the compressed storage configuration, the reward facing surface 502 becomes an outward facing surface. The closure flap is adorned with hardware 506 including a top panel 508, one or more fasteners 510, and a keychain or clasp 512. Fasteners may include snaps, clasps, zippers, hook and loop, or the like. In some embodiments, fasteners 510 may be snaps having a female snap portion 514 configured to receive a male snap portion 516. Fasteners are positioned along an upper margin and lower margin of the closure flap 108 such that the bottom margin may be secured to the upper margin. Although the figures depict female snap portion 514 along the top margin and male snap portion 516 along the bottom margin of the closure flap 108, it should be understood that these positions may be reversed. As shown, the female snap portion 514 is on the forward facing surface 502 of the closure flap 108, and the male snap portion 516, that interfaces with the female snap portion 514, projects outwardly from the rearward facing surface 504. Accordingly, to seal the closure flap 108, the bottom margin of the flap is curled around and under the top margin of the flap such that the closure flap 108 forms a cylindrical shape, as seen in FIG. 7I, with the rearward facing surface 504 facing outwardly. In embodiments, the body portion 528 closure flap 108 is formed of a material having a high tensile strength while remaining flexible. In embodiments, the body portion 528 of the closure flap 108 is leather. In embodiments, the body portion 528 of the closure flap 108 is synthetic leather. In embodiments, the body portion 528 closure flap 108 may be two synthetic leather panels stitched together. In such embodiments, a back side of the female snap portion 514 may be hidden from view between the two panels. Accordingly, once the bottom margin is folded underneath the top margin and the snaps are secured, the fasteners may be completely hidden from view creating an appealing aesthetic appearance for the tote in the compressed storage configuration.

Figure 5C:
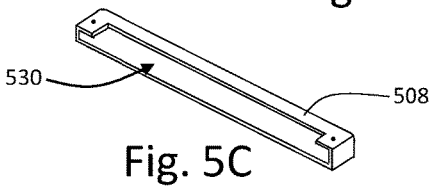
FIG. 5*c* is a perspective few of a top panel of a closure flap in accord with embodiments.

The top panel 508 may extend across a top margin of the closure flap 108. In some embodiments, on the rearward facing surface 504, the top panel 508 may appear as a solid bar. In some embodiments, the top panel 508 may be shaped to conform to fasteners 510 on the forward facing surface 502. Referring to FIG. 5C, in some embodiments, the top panel 508 may define an interior cavity 530. The interior cavity 530 may generally conform to the body portion 528 such that a margin of the body portion 528 may fit within the cavity 530. In embodiments, the fit is a snug fit. In embodiments, the body portion 528 may be affixed to the top panel 508 with an adhesive such as glue or the like. In embodiments, the portion 524 may be affixed to the top panel 508 with a fastener. Such fasteners include screws, nails, rivets, or the like. As noted above and discussed in further detail below, this achieves an appealing aesthetic, particularly when the closure flap 108 is rolled and sealed in the compressed storage configuration. The top panel 508 may further act as a grip or handle, facilitating opening and sealing the closure flap 108. Further yet, the top panel 508 serves to extend the life of the closure flap 108 by reducing wear and tear on frangible fabrics in high contact areas.

In embodiments, the closure flap 118 may include additional hardware 506 such as a keychain 118. The keychain 118 may be any sort of hook, loop, carabiner, or the like. The keychain 118 may be affixed along a side margin of the closure flap 108. In some embodiments, there may be an intermediary attachment 518 such as a loop or the like, connecting the keychain 118 to an attachment point on the closure flap 108. In some embodiments, a swivel 520 may allow the keychain 118 and closure flap 108 to rotate with respect to one another. In some embodiments, the swivel 520 may be incorporated into the intermediary attachment 518, the keychain 118, the closure flap 118, or portions of the swivel may be incorporated into various components of the elements. In some embodiments, the keychain 118 may include an operable arm 522 mounted on a biased pivot point, allowing the keychain 118 to easily attach to other devices. The keychain 118 provides the added benefit, particularly in the compressed storage configuration, of being able to secure the tote 100 to a purse, belt or belt loop, other bag, or the like. Accordingly, the tote 100 may be transported hands free. This feature adds additional convenience to transport the tote 100 in the compressed configuration and have it readily available when needed for opening up the tote 100 and adding items to the internal compartment 110.

In some embodiments, the hardware 506 may be metallic, formed of metals, metal alloys, or the like. In some embodiments, the hardware 506 may be formed of durable polymers such as plastics. In some embodiments, each component of the hardware 506 may be formed of the same material. In some embodiments, each component of the hardware 506 may be formed of different materials. For example, the fasteners 510 may be formed of metal and the keychain 118 may be formed of plastic. In some embodiments, the hardware 506 may be tarnish resistant. In some embodiments, the hardware 506 may be plated, for example, with precious or semi-precious metals such as gold, silver, nickel, bronze, or the like. The hardware 506 may have further features to enhance aesthetic appeal such inclusion of gems, etching, coatings, or the like. For example, the hardware 506 may be matte finished, brushed, polished, aged, powder coated, or the like.

In embodiments, the closure flap has a width 524 between 2 to 6 inches and a length 526 between 4 to 8 inches. In embodiments, the closure flap has a width 524 of about 3.5 inches and a length 526 of about 6.5 inches. In embodiments, a width 218 of the front panel 112 is between 4 and 4.5 times a width 524 of the closure flap 108. In some embodiments a length 220 of the front panel 112 is between 2 and 2.5 times a length 526 of the closure flap 118.

Figure 6A:
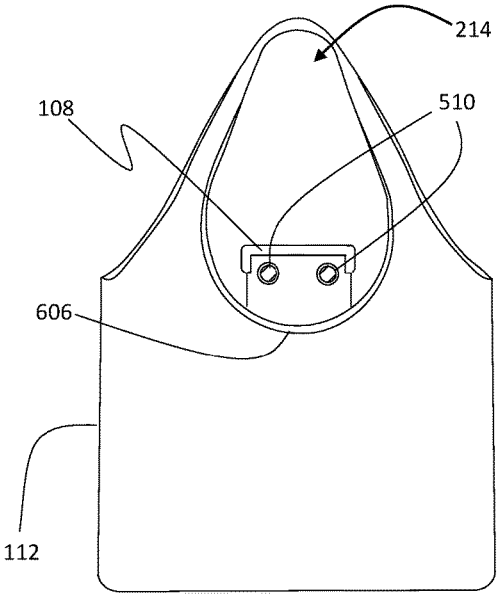
FIG. 6A is a front view of a reusable tote in accord with embodiments.
Figure 6B:
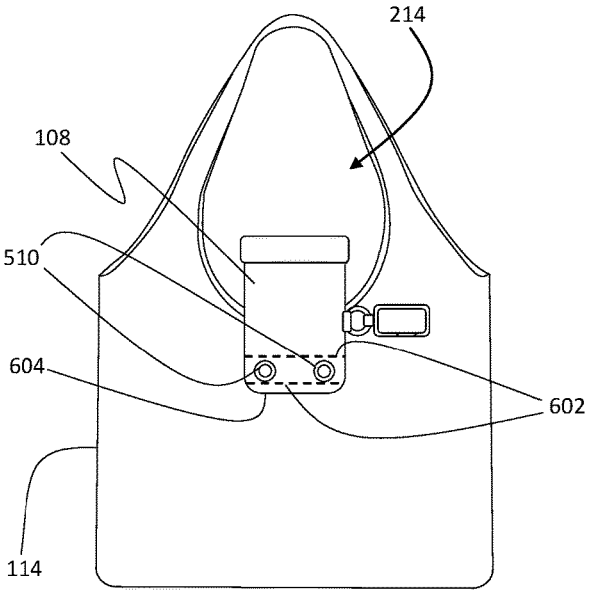
FIG. 6B is a rear view of a reusable tote in accord with embodiments.

FIGS. 6A and 6B illustrate the closure flap 108 affixed to the back panel 114. A bottom margin of the closure flap 118 may be affixed to the back panel 114, for example, by stitching, sewing, or the like. In some embodiments, the closure flap 108 may be stitched to the back panel 114 at seams 602 above and below fasteners 510. The closure flap 108 may be generally centered between right and left edges 210, 214 of the back panel 114. As shown, a top portion of the closure flap 108 may project upwardly into the opening 214. The bottom margin of the closure flap 108 may be affixed below the bottom edge of the opening 214. In embodiments, a bottom edge 604 of the closure flap 108 is mounted between 1 to 3 inches below a bottom edge 606 of the handle opening 214. In some embodiments, the bottom edge 604 of the closure flap 108 is mounted about 1.5 inches below the bottom edge 606 of the handle opening 214. Said differently, there is at least about 1-3 inches of overlap between the back panel 114 and the closure flap 108.

As discussed throughout, a feature of the reusable tote bag 100 is that it transitions from an open configuration to a compressed storage configuration. FIGS. 7A to 7I depict the steps to transition the tote bag 100. In a first step, shown in FIG. 7A, the tote 100 is laid flat such that the front and back panels 112, 114 are generally aligned and in contact with one another, the handles 104, 106 extending upwardly and the closure flap 108 positioned within the opening 214. In the next step, shown in FIG. 7B, the handles 104, 106 are folded downwardly and laid atop the front panel 112. Accordingly, the sac now has a generally rectangular shape with the closure flap 108 projecting upwardly.

Figure 7A:
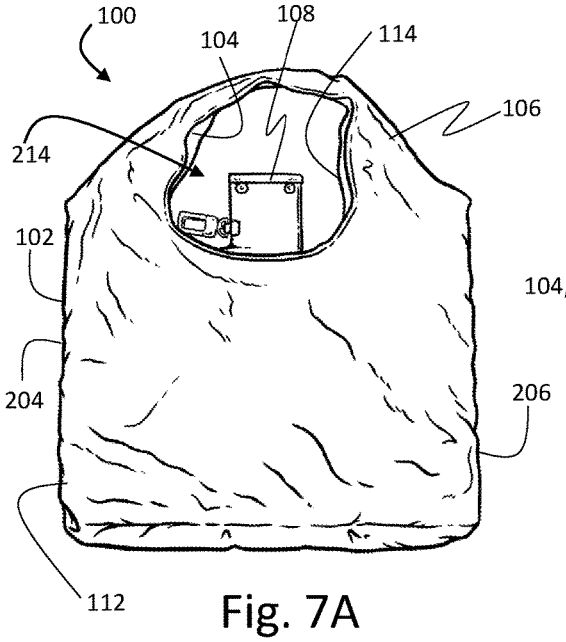
FIG. 7A is a front view of a reusable tote in accord with embodiments.
Figure 7B:
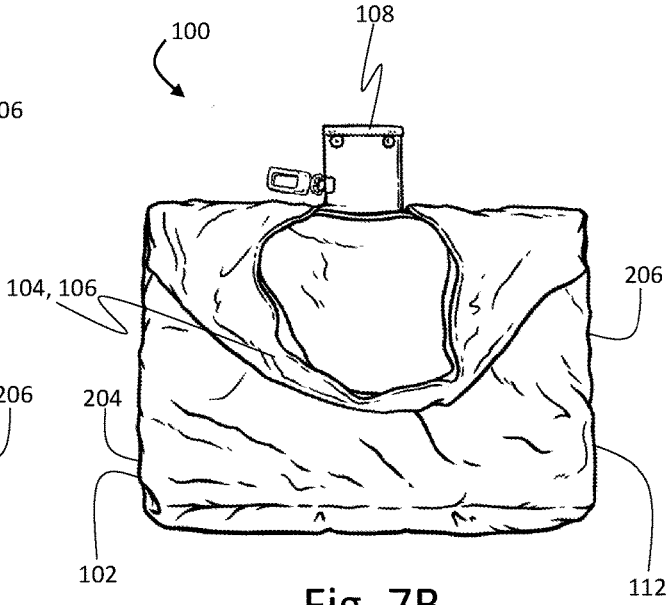
FIG. 7B is a front view of the reusable tote of FIG. 7A with the handles folded down.
Figure 7C:
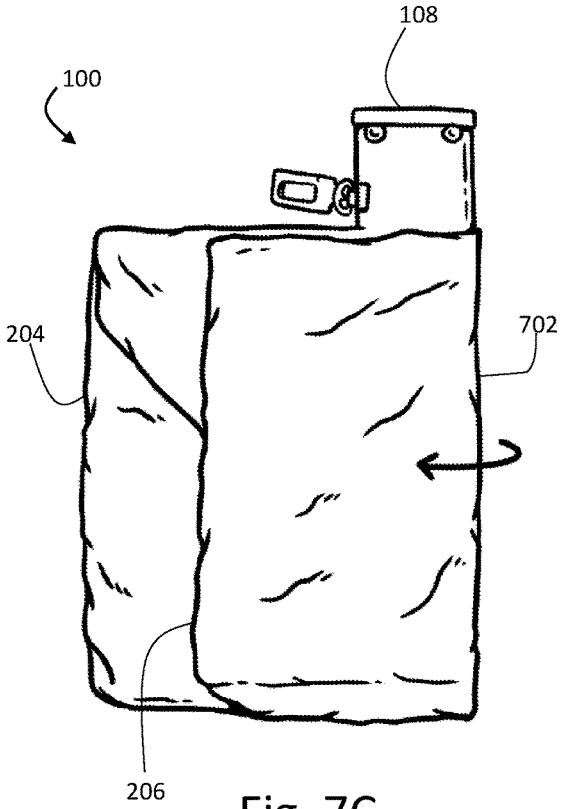
FIG. 7C is a front view of the reusable tote of FIG. 7B with a right edge of the tote folded towards a left edge of the tote.
Figure 7D:
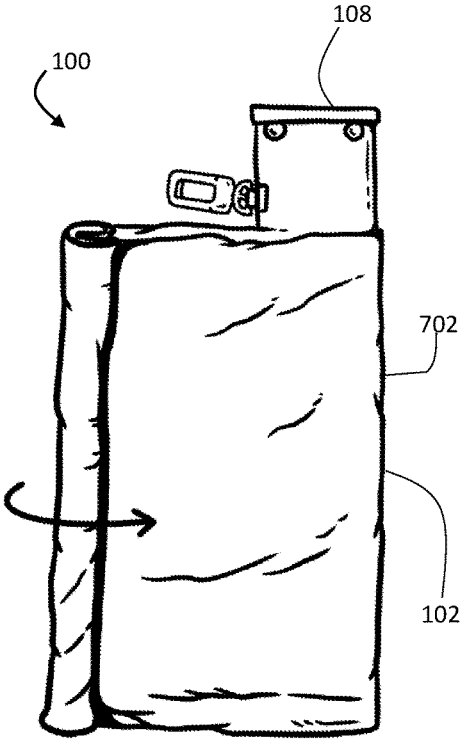
FIG. 7D is a front view of the reusable tote of FIG. 7C with the left edge of the tote being folded towards a center of the tote.
Figure 7E:
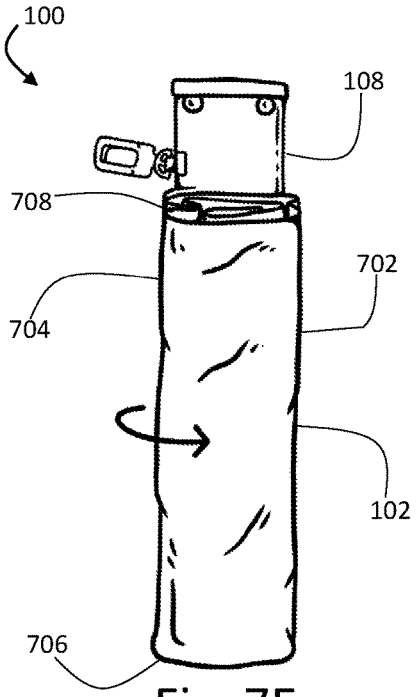
FIG. 7E is a front view of the reusable tote of FIG. 7D with the left edge folded.
Figure 7F:
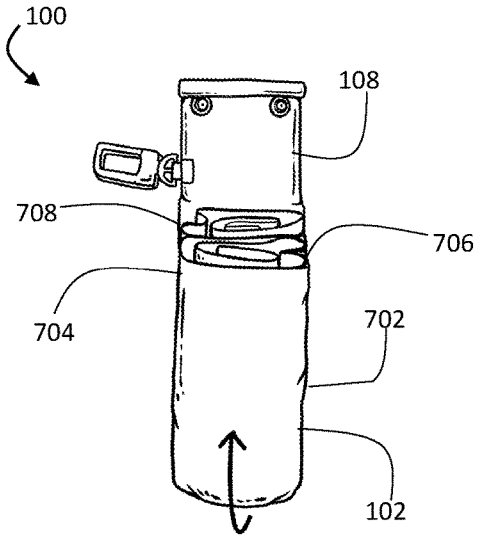
FIG. 7F is a front view of the reusable tote of FIG. 7E with a bottom edge folded upwards.
Figure 7G:
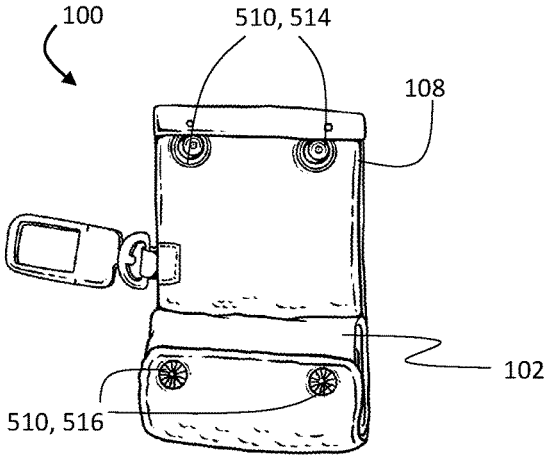
FIG. 7G is a front view of the reusable tote of FIG. 7F with a bottom edge of a closure flap rolled around the folded sac portion.
Figure 7H:
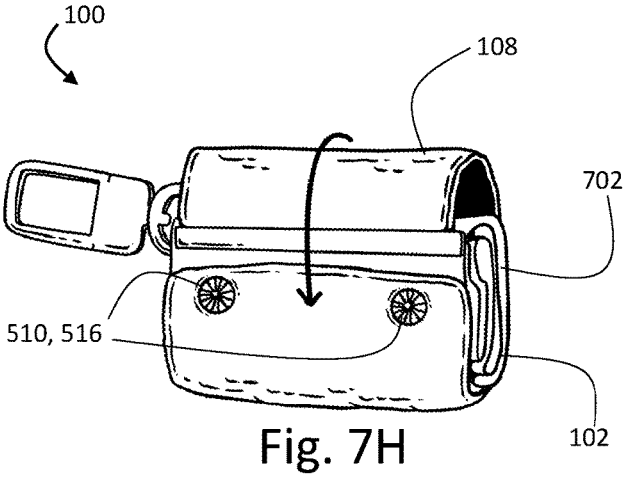
FIG. 7H is a front view of the reusable tote of FIG. 7G with a top edge of the closure flap rolled down towards the bottom edge of the closure flap.
Figure 7I:
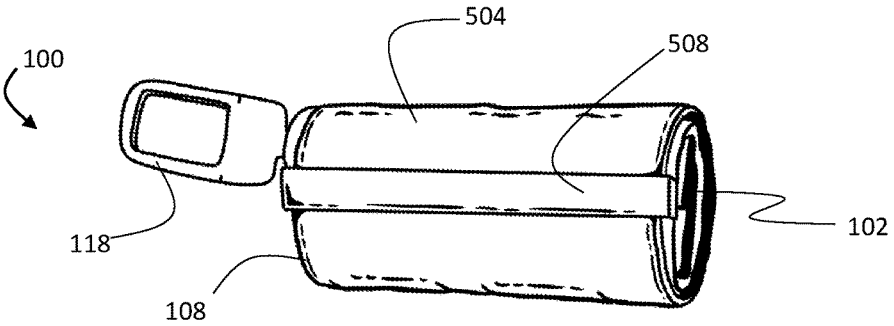
FIG. 7I is a front perspective view of the reusable tote of FIG. 7A in a compressed storage configuration.

As shown in FIG. 7C, the right side 206 of the sac 102 may be folded towards left side 204, creating a new right edge 702 that is generally aligned with an edge of the closure flap 108. As shown in FIG. 7D, left side 204 of the sac 102 may be folded back towards the new right edge 702. It should be noted that although FIGS. 7C and 7D show a first fold of the ride side towards the left followed by a fold of the left side towards the right, these directions may be reversed. Regardless of whether the left or right side is the first to be folded, followed by folding the opposite side, the result will be that the tote ends in the state illustrated in FIG. 7E, with the sac portion 102 having left and right edges 702, 704 that generally align with left and right edges of the closure flap 108. It should also be noted that in some steps, the act of folding may be replaced or incorporated with the act of rolling, even where not explicitly stated as such. Referring to FIG. 7F, a bottom edge 706 of the sac portion 102 may be rolled, folded, or a combination of both, towards top edge 708. Once the sac portion 102 has been fully rolled or folded, continuing to advance the tote in an upward direction will start the process of wrapping the closure flap 108 about the sac portion 102 as depicted in FIG. 7G. Referring to FIG. 7H, the top margin of the closure flap 108 may be folded downward and fastened to the bottom margin of the flap 108. FIG. 7I depicts the tote 100 in the compressed storage configuration. As shown, the sac portion 102 is substantially contained with the margins of the closure flap 108. It will be appreciated that the rearward facing surface 504 is now an outward facing surface in the storage configuration. In some embodiments, the fasteners are hidden from view in the storage configuration for an appealing aesthetic appearance.

Each feature disclosed in this specification (including references incorporated by reference, any accompanying claims, abstract and drawings) may be replaced by alternative features serving the same, equivalent or similar purpose, unless expressly stated otherwise. Thus, unless expressly stated otherwise, each feature disclosed is one example only of a generic series of equivalent or similar features.

The invention is not restricted to the details of the foregoing embodiment(s). The invention extends to any novel one, or any novel combination, of the features disclosed in this specification (including any incorporated by reference references, any accompanying claims, abstract and drawings), or to any novel one, or any novel combination, of the steps of any method or process so disclosed. The above references in all sections of this application are herein incorporated by references in their entirety for all purposes.

Although specific examples have been illustrated and described herein, it will be appreciated by those of ordinary skill in the art that any arrangement calculated to achieve the same purpose could be substituted for the specific examples shown. This application is intended to cover adaptations or variations of the present subject matter. Therefore, it is intended that the invention be defined by the attached claims and their legal equivalents, as well as the following illustrative aspects. The above described aspects embodiments of the invention are merely descriptive of its principles and are not to be considered limiting. Further modifications of the invention herein disclosed will occur to those skilled in the respective arts and all such modifications are deemed to be within the scope of the invention.

What is claimed is:

1. A compact reusable tote comprising:

a sac configured to transition between an open carry configuration and a compressed storage configuration, the sac comprising:

a front panel affixed to a back panel, the front and back panels being generally symmetrical and each having a generally rectangular lower portion and an upper portion with an integral strap formed as part of the panel, the front and back panels defining an interior compartment; and a closure flap comprising a body portion and a top panel comprising a solid bar affixed thereto, the body portion having a generally rectangular shape including opposing top and bottom margins, and opposing left and right edges, the bottom margin affixed to the sac, the bottom margin of the body portion having a first fastener portion which cooperates with a second fastener portion, the second fastener portion affixed along the top margin, wherein the top panel defines a cavity configured to receive a margin of the body portion, and wherein in the storage configuration the first and second fastener portions are mated to one another such that no portion of the sac extends beyond the left and right edges of the body portion.

2. The compact reusable tote of claim 1, further comprising a gusset panel disposed between the front and back panels.

3. The compact reusable tote of claim 1, wherein the interior compartment in the open carry configuration has a volume between 600 and 1200 cubic inches.

4. The compact reusable tote of claim 3, wherein the interior compartment in the compressed storage configuration has a volume less than 50 cubic inches.

5. The compact reusable tote of claim 1, wherein the body portion of the closure flap has a width of about 3.5 inches and a length of about 6.5 inches.

6. The compact reusable tote of claim 1, wherein a width of the front panel is between 4 and 4.5 times a width of the closure flap.

7. The compact reusable tote of claim 1, wherein a length of the front panel is between 2 and 2.5 times a length of the body portion of the closure flap.

8. The compact reusable tote of claim 1, wherein the first fastener portion is a first snap portion and the second fastener portion is a corresponding snap portion configured to mate with the first snap portion.

9. The compact reusable tote of claim 1, wherein a keychain is affixed to the closure flap.

10. The compact reusable tote of claim 1, where the closure flap is generally centered between a left side edge and a right side edge of the back panel.

11. A method of transitioning a compact reusable tote having a sac affixed to a bottom margin of a closure flap, the closure flap comprising a body portion and a top panel comprising a solid bar affixed thereto and extending at least from a left edge of the body portion to the right edge of the body portion, from an open carry configuration to a compressed storage configuration, the method comprising:

laying the sac flat such that a front panel lays atop a back panel with outside edges of the panels being substantially aligned and a pair of integral straps formed as part of the panels extend upwardly;

folding the pair of integral straps downwardly such that the sac has a clearly defined rectangular shape with a left, right, bottom, and top edges;

arranging the closure flap to project upwardly from the top edge of the sac such that the left and the right edge of the body portion are generally parallel to the left and right edges of the sac;

folding a right edge of the sac over the front panel at a first crease, the first crease being axially aligned with the right edge of the closure flap body portion;

folding a left edge of the sac towards the first crease;

folding the bottom edge of the sac upwardly towards the closure flap until the rolled up sac reaches the closure flap;

rolling the closure flap around the rolled up sac until the bottom margin of the closure flap reaches a top margin of the closure flap; and fastening the bottom margin of the closure flap to a top margin of the closure flap.

12. The method of claim 11, wherein after the sac is laid flat, an interior surface of the front panel is in contact with an interior surface of the back panel such that an interior volume of the sac is near zero.

13. The method of claim 11, wherein the step of fastening the bottom margin of the closure flap to the top margin of the closure flap comprises mating a male portion of a snap with a female portion of the snap.

14. A collapsible tote comprising:

a rectangular closure flap comprising a body portion and a top panel comprising a solid bar affixed thereto, the body portion having a top margin configured to fasten to a bottom margin, the top panel defining a cavity configured to receive the top margin of the body portion; and a sac comprising symmetrical front and back panels, the front and back panels affixed along left, right, and bottom edges and defining an interior compartment therebetween, wherein the bottom margin of the rectangular closure flap is affixed to a top edge of the sac back panel at a midpoint between the left and right panel edges, the sac being configured to roll into a bundle and secured in place when the top flap margin is secured to the bottom flap margin.

15. The collapsible tote of claim 14, wherein the sac is configured to transition between an open carry configuration and a compressed storage configuration.

16. The collapsible tote of claim 15, wherein the sac is confined within a left margin and a right margin of the rectangular closure flap in the compressed storage configuration.

17. The collapsible tote of claim 14, wherein the sac is made from a water resistant material.

18. The collapsible tote of claim 17, wherein the water resistant material is nylon.

19. The collapsible tote of claim 14, wherein the rectangular closure flap is synthetic leather.

* * * * *